US005617784A

United States Patent [19]

St. John et al.

[11] Patent Number: 5,617,784

[45] Date of Patent: Apr. 8, 1997

[54] APPARATUS FOR BUNDLING, TRANSPORTING, AND FEEDING SHEETS

[75] Inventors: John St. John, Lake Arrowhead; Allyn Peterson, San Bernardino, both of Calif.

[73] Assignee: Baldwin Technology Corporation, Rosemont, Ill.

[21] Appl. No.: 539,682

[22] Filed: Oct. 5, 1995

[51] Int. Cl.[6] ..... B65B 27/08

[52] U.S. Cl. ..... 100/3; 100/7; 100/8; 414/790.2; 414/907

[58] Field of Search ..... 100/2, 3, 7, 8, 100/26; 414/790.2, 907

[56] References Cited

U.S. PATENT DOCUMENTS 3,739,924 6/1973 Stobb .
3,825,134 7/1974 Stobb . .
4,498,381 2/1985 Convey, Jr. ..... 100/7
4,772,169 9/1988 Masini .
4,953,845 9/1990 Castiglionl .
4,977,827 12/1990 Chandhoke et al. ..... 100/7
5,215,428 6/1993 Masini .

*Primary Examiner*—Stephen F. Gerrity
*Attorney, Agent, or Firm*—Richard S. Roberts

[57] ABSTRACT

The invention provides an apparatus and method for feeding, bundling and transporting a stream of sheets, such as printed sheets in signature form. A vertical stacking machine stacks a stream of signatures and then clamps, compresses and straps the signatures into a bundle for transportation and delivery. The machine has a pair of improved bar clamps for preventing sheet drift during compression and strapping. The clamps attach each bar to a driving mechanism in a cantilevered fashion. Each bar is only attached to the driving mechanism at the top and/or the center portion of the bar. The opposite, bottom end of each bar is free of attachment to the driving mechanism. As a result, a critical obstruction is removed.

28 Claims, 4 Drawing Sheets

APPARATUS FOR BUNDLING, TRANSPORTING, AND FEEDING SHEETS

BACKGROUND OF THE INVENTION

1. Field of the Invention

The present invention relates to an apparatus for stacking, bundling and transporting a stream of sheets, such as printed sheets, in signature form. The invention more particularly relates to a vertical stacking machine which stacks the stream of signatures and then compresses, clamps and straps the signatures into a bundle for transportation and delivery.

2. Description of the Prior Art

In the printing industry it is necessary to quickly handle printed sheets as they exit the high speed printing presses which are in common use today. The presses deliver printed sheets onto conveyors in serial, shingled form which then must be stacked into large bundles for delivery to a customer. Sheet stacking devices are commonly used for handling sheets as they are delivered from printing presses.

Printed sheet material is commonly delivered to a stacking machine in the form of folded sheet signatures which will be assembled to form a completed magazine or book. Vertical stackers are well known in the art as exemplified by U.S. Pat. Nos. 3,739,924; 3,825,134; 4,772,169; 4,953,845 and 5,215,428, which are incorporated herein by reference. Features common to prior art stackers are that they receive printed sheets, assemble them into a vertical stack and compress the stack from the top to remove entrained air. As used herein, "vertical" includes a stack which may be formed at any angle including those from true vertical to about 45° from true vertical. In virtually all vertical stackers in use today, a stack is actually formed at a slight angle to true vertical.

After a stack of sheets is formed, it must be compressed, strapped into a bundle and transported away from the stacker for other operations.. The industry has evolved such that stacking equipment can rapidly collect, stack, compress and bundle sheets at the speed they are produced by the printing press.

It has been desirable to employ high speed strapping equipment which automatically or semi-automatically ties the compressed stack into a bundle. In this regard, it is necessary to prevent the bundles from becoming disarranged during compressing and strapping. This avoids damage to the sheets by downstream machinery. It has therefore become common to clamp the stack along its sides during compression and strapping to prevent the sheets from drifting out of the stack during strapping. One or more clamps are initially positioned out of the path of the stack and, at the appropriate time, they are driven into the path of the stack at one side or opposite sides thereof and hold the stack sides. The clamps may engage either simultaneously or sequentially and advance until either the stack or a stop is reached. After strapping, the clamps retract and the bundle is transported away for the next operation. A problem in the art is that currently used clamps obstruct strapping equipment. This has necessitated the use of expensive, custom made strapping equipment in order to avoid these obstacles. According to the present invention, a stacking machine is provided which has an improved clamping mechanism. The inventive clamps comprise one or more and preferably a pair of opposing bars attached to the driving mechanisms in a cantilevered fashion. That is, connecting rods are attached to each bar only at the top and/or the center portion of the bar. The opposite, bottom end of each bar is free of attachment to the connecting rods and driving means. As a result, a critical obstruction is removed. This frees crucial space and allows the use of much less expensive strapping equipment which is common in the printing industry.

An important feature of the present invention is to provide an automated system for receiving, stacking, clamping, compressing and transporting sheets, which has an improved cantilevered clamping means which can be readily and easily positioned on and removed from the stack of sheets. The clamp of the present invention operates such that when the bundle is compressed and the clamp is positioned in tight contact with the opposite sides of the bundle, the clamp will automatically hold in that position until the bundle is strapped after which the clamp releases when the clamped bundle is finally positioned for transportation. These and other objects and advantages of the invention will become apparent upon a consideration of the following detailed description.

SUMMARY OF THE INVENTION

The invention provides an apparatus for stacking, bundling and transporting sheets comprising. It has sheet feeding means capable of feeding a series of sheets in signature form to sheet stacker means. It has sheet stacker means capable of continuously receiving sheets from the sheet feeding means and stacking the sheets into a discrete stack on a support surface. It further has compressor means capable of compressing the stack on the support surface and clamping means capable of securing the sheets in the compressed stack. The clamping means comprise at least one cantilevered bar extending along the length of at least one of the sides of the stack. Each bar is attached to driving means capable of alternately driving the bars toward the stack until either the stack or a stop is reached and releasing the stack. The driving means are attached to each bar at one end of each bar wherein an opposite end of each bar is free of attachment to the driving means. Preferably the apparatus further comprises transporting means capable of moving the stack along a path from a first position on the support surface to a second position on the support surface.

The invention also provides a method for stacking, bundling and transporting sheets comprising providing the above apparatus; feeding a series of sheets in signature form to the sheet stacker means; continuously receiving sheets from the sheet feeding means and stacking said sheets into a discrete stack on a support surface; securing the sheets in the stack with the clamping means by driving at least one of the cantilevered bars towards the stack with the driving means until the stack or a stop is reached; compressing the stack; preferably applying a strapping around the stack; and releasing the stack.

DETAILED DESCRIPTION OF THE PREFERRED EMBODIMENT

Figure 1:
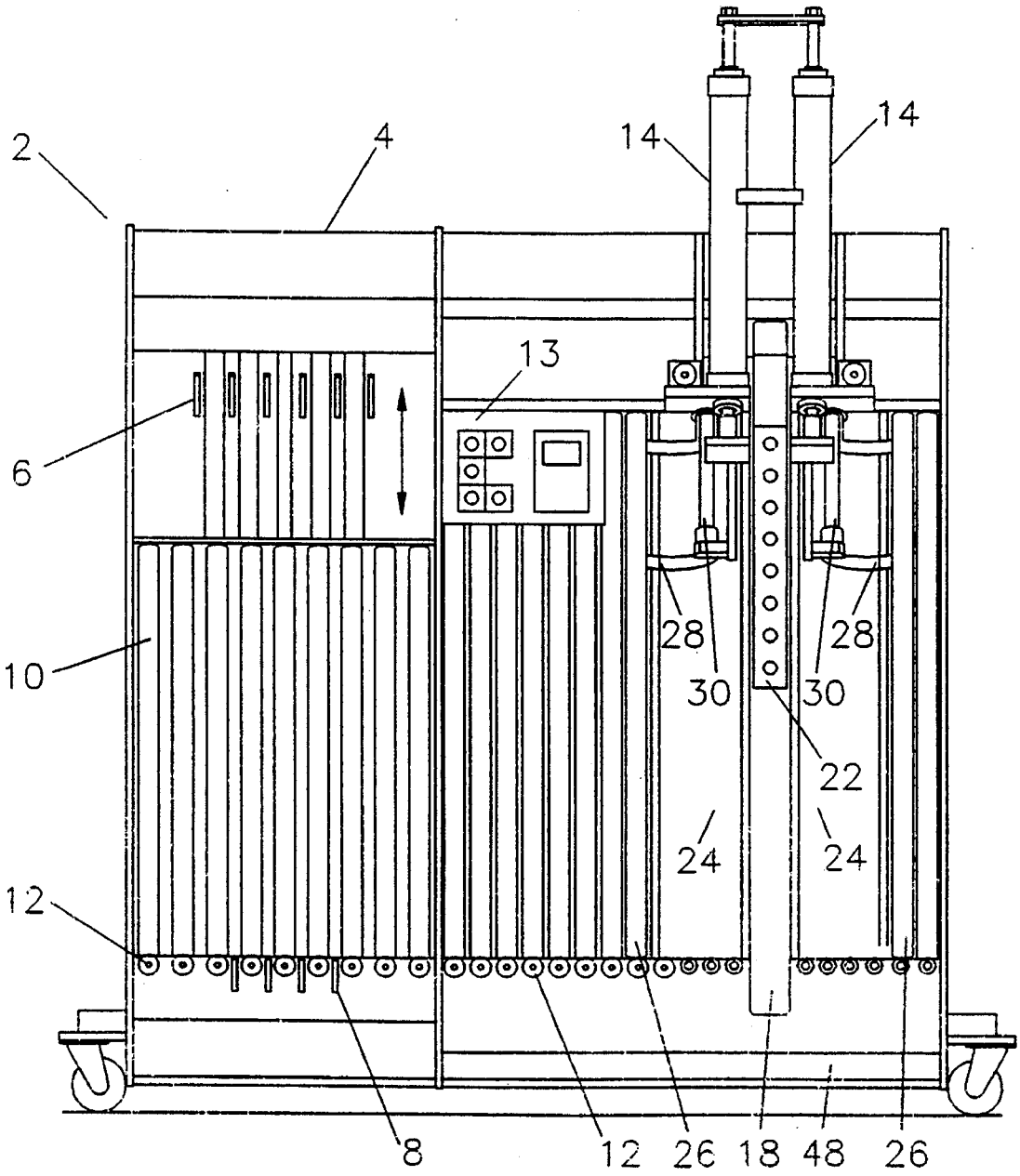
FIG. 1 shows a front elevational view of a vertical stacker according to the invention.

FIG. 1 shows a front view of a vertical sheet stacker 2 according to the invention. It shows a delivery device 4 which receives sheets in a shingled stream. The sheets are carried to the upper end of the delivery device 4 and are stripped from their stream in imbricated form and are placed into an aligned stack. The sheets are stacked into a slightly inclined collection onto a series of upper support fingers 6. Fingers 6 project forward approximately twelve inches and form a platform to collect the signatures in vertical form and slowly descend. The fingers are capable of travelling an up and down path in the direction of the arrow as shown. These fingers 6 collect the signatures in vertical form and as the stack grows, the fingers slowly descend. When fingers 6 reach their lowermost position of travel, they retract into the stacker and the stack is transferred to a series of lower support fingers 8. The lower support fingers, which also project forward approximately twelve inches to form a second platform, descend and transfer the stack to horizontal support rollers 12. Lower support fingers 8 travel up and down between slightly inclined vertical support rollers 10 which provide back support to the stack. Preferably either manually or automatically positioned on the lower support fingers 8 is a plywood bottom end board which protects the lowermost signatures during subsequent movement, compression and strapping. In operation, the lower support fingers 8 rise up to meet the stack growing on the upper support fingers 6. Upper support fingers 6 then retract and transfer the stack to the lower support fingers 8. The lower support fingers transfer the stack and lower end board to horizontal support rollers 12. When the stack is of full size, the formed stack is caused to travel to the right along the horizontal support rollers 12 to a compression station. Preferably, a protective plywood top end board is placed, either manually or automatically, on the stack before the stack enters into the compression station. Operation of the stacker may be controlled by control panel 13. The compression station comprises a pair of rams 14 which press down onto the stack to remove entrained air and reduce the height of the stack. The rams 14 extends along a plane parallel to the plane of the incline of the stack and press downwardly on the stack to compress the stack against the horizontal support rollers.

Figure 2:
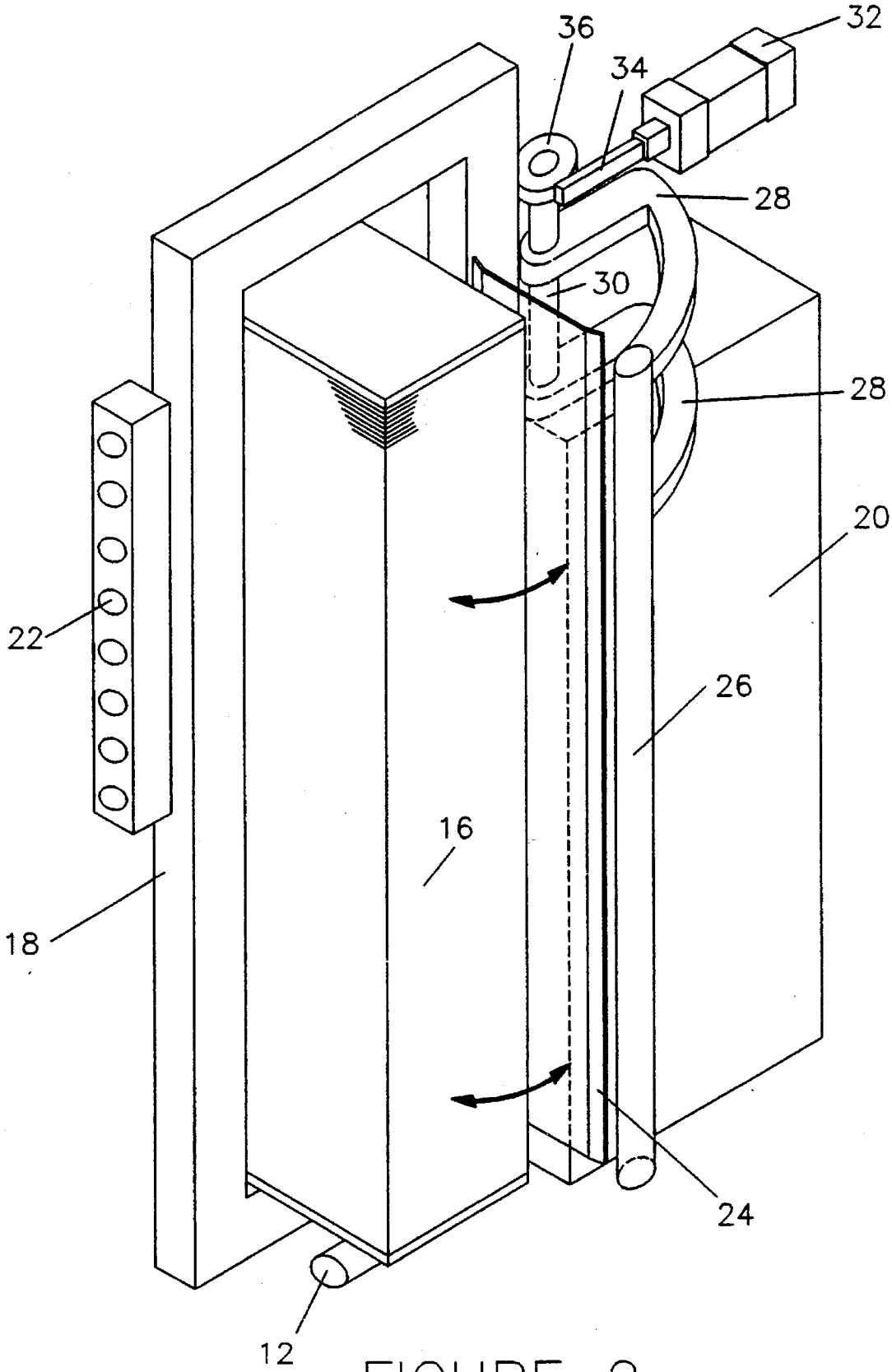
FIG. 2 shows a view of a portion of the stacker illustrating a novel clamping device prior to compacting a stack of signatures.

As best seen in FIG. 2, a formed stack 16 in the compression zone is surrounded by a strapping head 18. A strap, not shown, whips around the inside of the strapping head 18 and ties the stack into a strapped bundle. Strapping may be at the center of the stack or off-center. Strapping may be sequential at one or more locations on the bundle. The balance of the strapping mechanism 20 is attached to strapping head 18 behind the vertical support rollers 10 as shown. Control of the strapping mechanism operation may be by control panel 22. In the preferred embodiment, vertical support rollers 10 are substituted by slide-by panels 24 in the compression zone.

A bundle clamp is applied to the stack 16 to hold the stack curing the compression cycle in the compressed condition during strapping. The clamp is comprised of at least one and preferably a pair of opposing bars 26 which hold the stack 16 on opposite sides thereof. Each bar is cantilevered and extends along the length of one side or two opposite sides of the stack. Each bar is attached to driving means which alternately drives the bars toward and preferably against the stack during strapping and then releases the stack. The driving means preferably comprises a pair of curved connecting members or C-shaped rods 28 which are attached to each bar at only one end of each bar. The opposite bottom end of each bar is free of attachment to the driving means. Importantly, the driving means is positioned only at the upper half preferably only at the upper quarter of each bar. This allows the rods 28 to swing over and clear of the strapping mechanism 20. The curved connecting members 28 are attached at one end to one of the bar as shown and at another end to pivoting means 30. The pivoting means is capable of moving the curved connecting member and the attached bar along a curved path of movement toward and away from the stack as shown by the arrow in FIG. 2. The pivot is preferably driven by air cylinders 32 which actuate rack 34 and gear drive 36. While clamp bar 26 and ram 14 are applied to the bundle 16, a strap is tied around the bundle via strapping head 18.

Thereafter the ram 14 and clamp bar 26 are released and the strapped stack is then be moved out of the compression zone.

Figure 3:
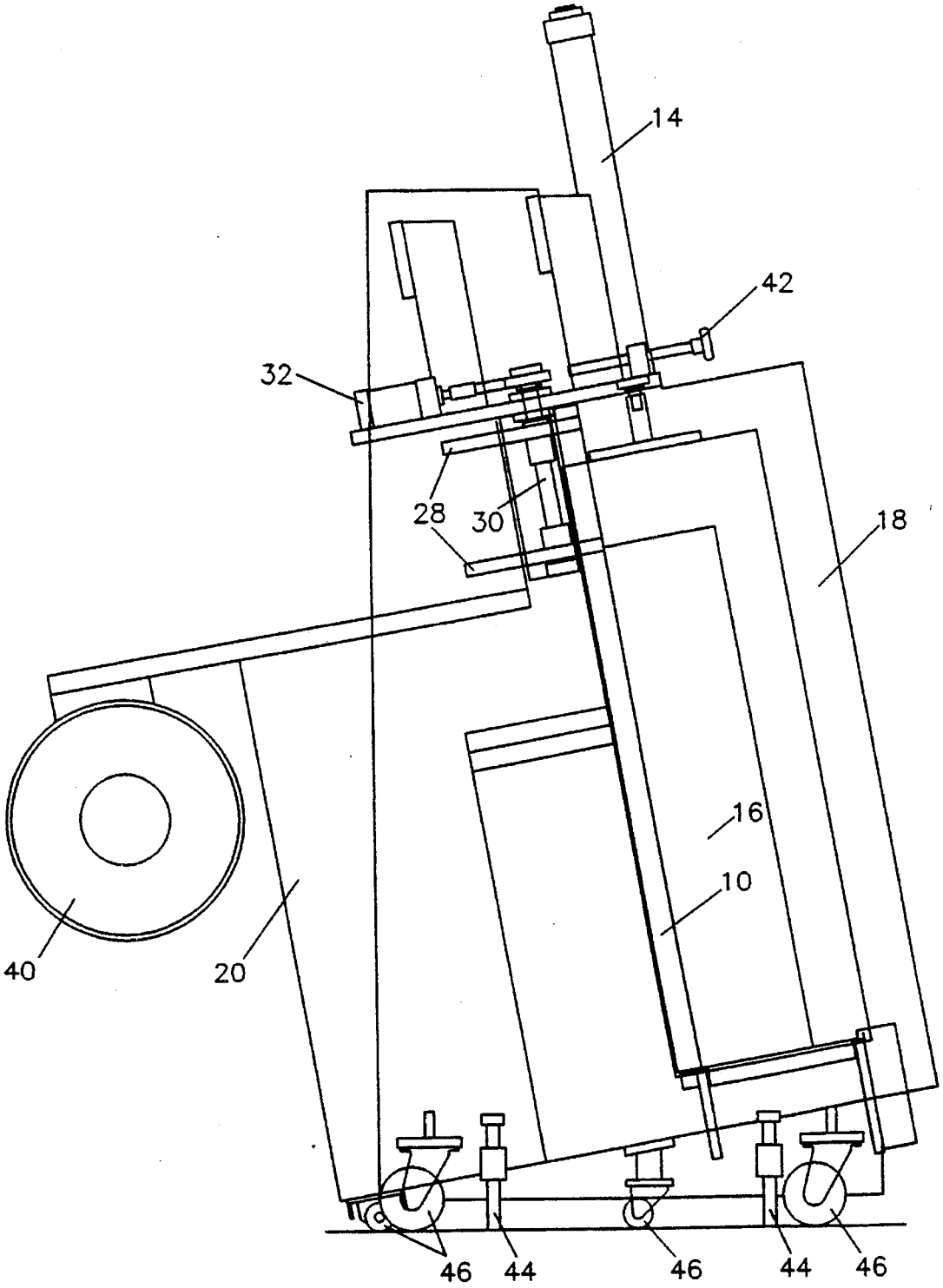
FIG. 3 shows a side view of the stacker including a strapping device.
Figure 4:
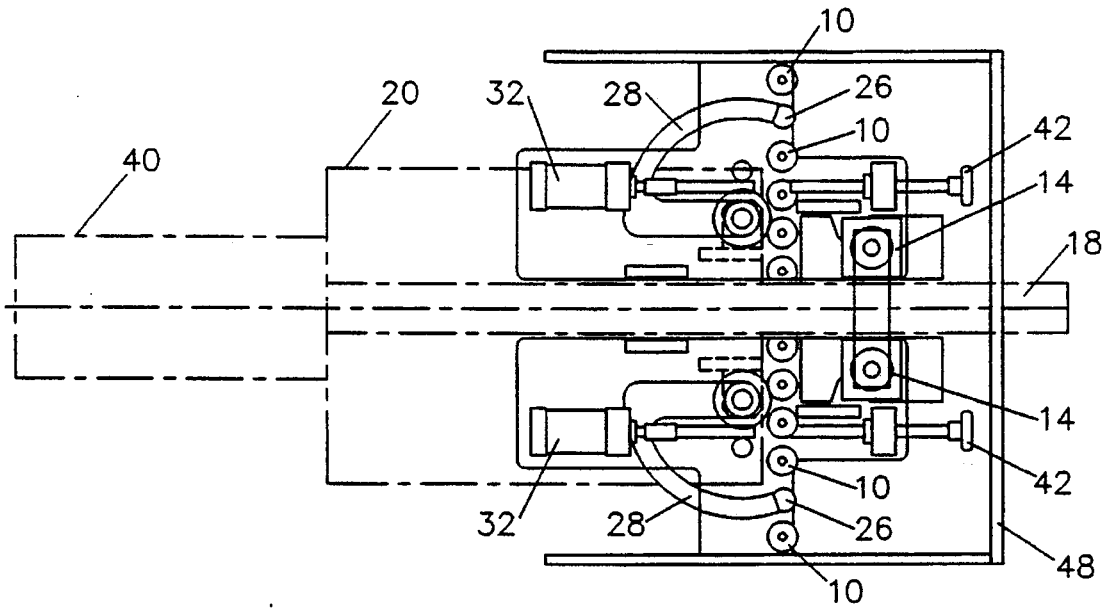
FIG. 4 shows a top view of a central section of the stacker.

FIG. 3 shows a side view of the vertical stacking machine according to the invention. In this view one can more clearly see the incline of the stack 16, ram 14, vertical support rollers 10, horizontal support rollers 12, strapping head 18 and the lower support fingers 8. The stacker can be adjusted by a suitable leveling jack screw 44. The strapping mechanism 20 is also tilted at a complementary angle to abut against the rear portion of the stacker. The strapping is fed to the strapping mechanism 20 by a suitable supply roller 40. The travel of the clamping bar 26 and connecting rod 28 can be adjusted by suitable adjusting means 42. As shown, the stacking machine and strapping mechanism 20 can be moved from one location to another as assisted by wheels 46. FIG. 4 shows a top view of the portion of the apparatus of the invention depicted on the right side of FIG. 1. In this view one can see a surrounding baseplate 48. In an alternative embodiment shown in FIG. 4, slide-by panels 24 are replaced by additional vertical support rollers 10.

In operation, delivery device 4 receives sheets in a shingled stream at the upper end of the delivery device. The sheets are stacked onto upper support fingers 6. Fingers 6 collect the signatures in vertical form and slowly descend. When fingers 6 reach their lowermost position of travel, they retract into the stacker and the stack is transferred to lower support fingers 8 which are at their highest position. Preferably positioned on the lower support fingers 8 is a plywood bottom end board. The lower support fingers descend and transfer the stack to horizontal support rollers 12. Then preferably, a protective plywood top end board is placed on the stack. The formed stack moves to the right along the horizontal support rollers 12 to a compression station. At the compression station, the bundle clamp is applied to the stack 16 to hold the sides of stack. Air cylinders 32 actuate rack 34 and gear drive 36 to pivot C-shaped rods 28 and hence bars 26. Cantilevered bars 26 hold the stack 16 on one side or two opposite sides. When the stack 16 is in the compression zone it is surrounded by a strapping head 18. A pair of inclined rams 14 press down onto the stack to remove entrained air and reduce the height of the stack. A strap then travels around the inside of the strapping head 18 and ties the stack into a strapped bundle. Then the ram 14 and clamp bar 26 are released and the strapped stack is moved out of the compression zone.

What is claimed is:

1. An apparatus for stacking, bundling and transporting sheets comprising:

a) sheet feeding means capable of feeding a series of sheets in signature form to sheet stacker means, b) sheet stacker means capable of continuously receiving sheets from the sheet feeding means and stacking said sheets into a discrete stack on a support surface, c) compressor means capable of compressing the stack on the support surface, d) clamping means capable of securing the sheets in the compressed stack, said clamping means comprising at least one cantilevered bar extending along the length of at least one of the sides of the stack; said at least one bar being attached to driving means capable of alternately driving the at least one bar toward the stack until either the stack or a stop is reached and releasing the stack, said driving means being attached to said at least one bar at one end of said at least one bar and wherein an opposite end of said at least one bar is free of attachment to the driving means.

2. The apparatus of claim 1 further comprising transporting means capable of moving the stack along a path from a first position on the support surface to a second position on the support surface.

3. The apparatus of claim 2 wherein the transporting means comprises a plurality of aligned, substantially vertically disposed rollers positioned for moving the stack.

4. The apparatus of claim 2 wherein the transporting means comprises a plurality of aligned, substantially vertically disposed rollers positioned for contacting the stack and the driving means drives the at least one bar between adjacent vertically disposed rollers.

5. The apparatus of claim 2 wherein the sheet stacker means forms a substantially vertical stack; the support surface comprises a plurality of substantially horizontally disposed rollers; the transporting means comprises a plurality of aligned, substantially vertically disposed rollers positioned for contacting the stack; the apparatus further comprises means for applying a strapping around the stack; said at least one bar is disposed in a substantially vertical position defining an upper end and a lower end and the driving means is positioned at the upper end of said at least one bar; the driving means comprises a curved, generally C-shaped connecting member attached at one end to said at least one bar and at another end to pivoting means, said pivoting means being capable of moving the curved connecting member and the attached bar along a curved path of movement toward and away from the stack; the driving means drives the at least one bar into and out of the stack movement path; and the driving means drives the at least one bar between adjacent vertically disposed rollers.

6. The apparatus of claim 5 wherein the curved connecting member comprises at least two curved connecting rods spaced from each other and each attached at one end thereof to said at least one bar and at another end thereof to the pivoting means and wherein the pivoting means comprises an air cylinder.

7. The apparatus of claim 1 wherein the clamping means comprises a pair of cantilevered bars each extending along the length of one of two opposite sides of the stack.

8. The apparatus of claim 7 wherein the driving means is capable of driving the bars toward the stack either simultaneously or sequentially.

9. The apparatus of claim 1 wherein the driving means further comprises an adjustable stop capable of limiting the travel of the at least one bar.

10. The apparatus of claim 1 wherein the sheet stacker means forms a substantially vertical stack.

11. The apparatus of claim 1 wherein the support surface comprises a plurality of substantially horizontally disposed rollers.

12. The apparatus of claim 1 further comprising means for applying strapping around the stack.

13. The apparatus of claim 1 wherein said at least one bar is disposed in a substantially vertical position defining an upper end and a lower end.

14. The apparatus of claim 1 wherein the driving means is positioned at the upper end of said at least one bar.

15. The apparatus of claim 14 wherein the driving means is positioned at the upper half of said at least one bar.

16. The apparatus of claim 14 wherein the driving means is positioned at the upper quarter of said at least one bar.

17. The apparatus of claim 1 wherein the driving means comprises a curved connecting member attached at one end to said at least one bar and at another end to pivoting means, said pivoting means being capable of moving the curved connecting member and the attached bar along a curved path of movement toward and away from the stack.

18. The apparatus of claim 17 wherein the driving means drives the at least one bar into and out of the stack movement path.

19. The apparatus of claim 7 wherein the curved connecting member comprises at least two curved connecting rods spaced from each other and each attached at one end thereof to said at least one bar and at another end thereof to the pivoting means.

20. The apparatus of claim 17 wherein the pivoting means comprises an air cylinder.

21. The apparatus of claim 17 wherein said curved connecting member is generally C-shaped.

22. The apparatus of claim 1 wherein the support surface is inclined from the horizontal.

23. A method for stacking, bundling and transporting sheets comprising

I) providing an apparatus comprising:

a) sheet feeding means capable of feeding a series of sheets in signature form to sheet stacker means, b) sheet stacker means capable of continuously receiving sheets from the sheet feeding means and stacking said sheets into a discrete stack on a support surface, c) compressor means capable of compressing the stack on the support surface, d) clamping means capable of securing the sheets in the compressed stack, said clamping means comprising at least one cantilevered bar extending along the length of at least one of the sides of the stack; said at least one bar being attached to driving means capable of alternately driving the at least one bar toward the stack until either the stack or a stop is reached and releasing the stack, said driving means being attached to said at least one bar at one end of said at least one bar and wherein an opposite end of said at least one bar is free of attachment to the driving means; and II) feeding a series of sheets in signature form to the sheet stacker means;

III) continuously receiving sheets from the sheet feeding means and stacking said sheets into a discrete stack on a support surface;

IV) securing the sheets in the stack with the clamping means by driving said at least one cantilevered bar towards the stack with the driving means until the stack or a stop is reached; and V) compressing the stack; and VI) releasing the stack.

24. The method of claim 23 wherein the apparatus further comprises transporting means capable of moving the stack along a path from a first position on the support surface to a second position on the support surface.

25. The method of claim 24 wherein the sheet stacker means forms a substantially vertical stack; the support surface comprises a plurality of substantially horizontally disposed rollers; the transporting means comprises a plurality of aligned, substantially vertically disposed rollers positioned for contacting the stack; the apparatus further comprises means for applying a strapping around the stack; said at least one bar is disposed in a substantially vertical position defining an upper end and a lower end and the driving means is positioned at the upper end of said at least one bar; the driving means comprises a curved, generally C-shaped connecting member attached at one end to said at least one bar and at another end to pivoting means, said pivoting means being capable of moving the curved connecting member and the attached bar along a curved path of movement toward and away from the stack; the driving means drives the at least one bar into and out of the stack movement path; and the driving means drives the at least one bar between adjacent vertically disposed rollers.

26. The method of claim 25 wherein the curved connecting member comprises at least two curved connecting rods spaced from each other and each attached at one end thereof to said at least one bar and at another end thereof to the pivoting means and wherein the pivoting means comprises an air cylinder.

27. The method of claim 23 further comprising the step of transporting the stack along a path from a first position on the support surface to a second position on the support surface.

28. The method of claim 23 further comprising the step of applying a strapping around the stack after step (V).

* * * * *